US012624534B2

(12) United States Patent
May et al.

(10) Patent No.: US 12,624,534 B2
(45) Date of Patent: May 12, 2026

(54) CONTROLLER

(71) Applicant: Kohler Mira Limited, Gloucestershire (GB)

(72) Inventors: Adam May, Bristol (GB); Neil James Baxter, Gloucestershire (GB); Richard J. Mead, Cheltenham (GB)

(73) Assignee: Kohler Mira Limited, Cheltenham (GB)

( * ) Notice: Subject to any disclaimer, the term of this patent is extended or adjusted under 35 U.S.C. 154(b) by 598 days.

(21) Appl. No.: 17/695,051

(22) Filed: Mar. 15, 2022

(65) Prior Publication Data

US 2022/0297147 A1 Sep. 22, 2022

(51) Int. Cl.
*E03C 1/05* (2006.01)

(52) U.S. Cl.
CPC ..... *E03C 1/057* (2013.01)

(58) Field of Classification Search
CPC .. G06F 3/0362; G06F 3/0393; G06F 3/04847; E03C 1/05; G05D 23/1353
See application file for complete search history.

(56) References Cited

U.S. PATENT DOCUMENTS

| | | | | |
|---|---|---|---|---|
| 2008/0259056 | A1 | 10/2008 | Freier et al. | |
| 2013/0113465 | A1 | 5/2013 | Padilla | |
| 2019/0010682 | A1* | 1/2019 | Wright | E03C 1/0408 |
| 2020/0089262 | A1* | 3/2020 | Wales | G05D 23/1353 |
| 2021/0062484 | A1* | 3/2021 | Wales | G05D 23/1393 |

FOREIGN PATENT DOCUMENTS

| | | | |
|---|---|---|---|
| CN | 110906043 | A | 3/2020 |
| DE | 102011054049 | A1 | 5/2012 |
| EP | 1609402 | A1 | 12/2005 |

OTHER PUBLICATIONS

European Office Action dated Sep. 29, 2022, issued in corresponding European application.
European Office Action dated Jun. 28, 2022, issued in corresponding European application.
European Official Action dated Dec. 12, 2024 issued in corresponding European application.

* cited by examiner

*Primary Examiner* — Kevin M Nguyen
(74) *Attorney, Agent, or Firm* — Husch Blackwell LLP

(57) ABSTRACT

A controller for use in a wet environment is provided. The controller includes a manually operable input device coupled to a base housing. The manually operable input device includes a first manual input member and a second manual input member, where the second manual input member is movable relative to the first manual input member. The manually operable input device includes a sealed environment disposed at least partially within the base housing and having one or more electronic components that control at least one function of a fluid delivery device. The one or more electronic components actuate responsive to user-initiated movement of the first manual input member and user-initiated movement of the second manual input member. The first manual input member and the second manual input member are disposed at least partially outside the sealed environment.

12 Claims, 3 Drawing Sheets

CONTROLLER

CROSS-REFERENCE TO RELATED PATENT APPLICATIONS

The present application claims the benefit of and priority to United Kingdom Patent Application No. 2103708.0, filed Mar. 17, 2021, the entire disclosure of which is hereby incorporated by reference herein.

BACKGROUND

The present disclosure relates to a controller for use in a wet environment such as an ablutionary setting. The disclosure also relates to fluid delivery systems, in particular plumbing or ablutionary systems, comprising such a controller.

SUMMARY

A first aspect is directed to a controller for use in a wet environment. The controller includes a manually operable input device coupled to a base housing. The manually operable input device includes a first manual input member and a second manual input member, where the second manual input member is movable relative to the first manual input member. The manually operable input device includes a sealed environment disposed at least partially within the base housing and having one or more electronic components that control at least one function of a fluid delivery device. The one or more electronic components actuate responsive to user-initiated movement of the first manual input member and user-initiated movement of the second manual input member. The first manual input member and the second manual input member are disposed at least partially outside the sealed environment.

A second aspect is directed to a controller for use in a wet environment. The controller includes a manually operable input device coupled to a base housing. The manually operable input device includes a first manual input member and a non-contact location sensing system having a first part disposed on the first manual input member and a second part disposed within the base housing. User-initiated movement of the first manual input member causes movement of the first part relative to the second part. The first part or the second part can detect movement of the other of the first part and the second part and output a signal in dependence on the user-initiated movement of the first part relative to the second part. The non-contact location sensing system is positioned such that, in use, the first part and the second part are not positioned in a common plane and are not radially offset from one another relative to an axis extending perpendicularly from the base housing and passing through the manually operable input device.

Another aspect is directed to a fluid delivery system. The fluid delivery system includes a fluid delivery device and a controller according to any one of the embodiments disclosed herein. The controller is operable to control one or more characteristics of the fluid delivered, in use, by the fluid delivery device. The one or more characteristics of the fluid may include at least one of a fluid flow or a temperature. The controller may be operably coupled to one or more valves upstream of the fluid delivery device.

Except where mutually exclusive, any of the features of any of the above-described aspects may be employed mutatis mutandis in any of the other above-described aspects.

DETAILED DESCRIPTION

Figure 1:
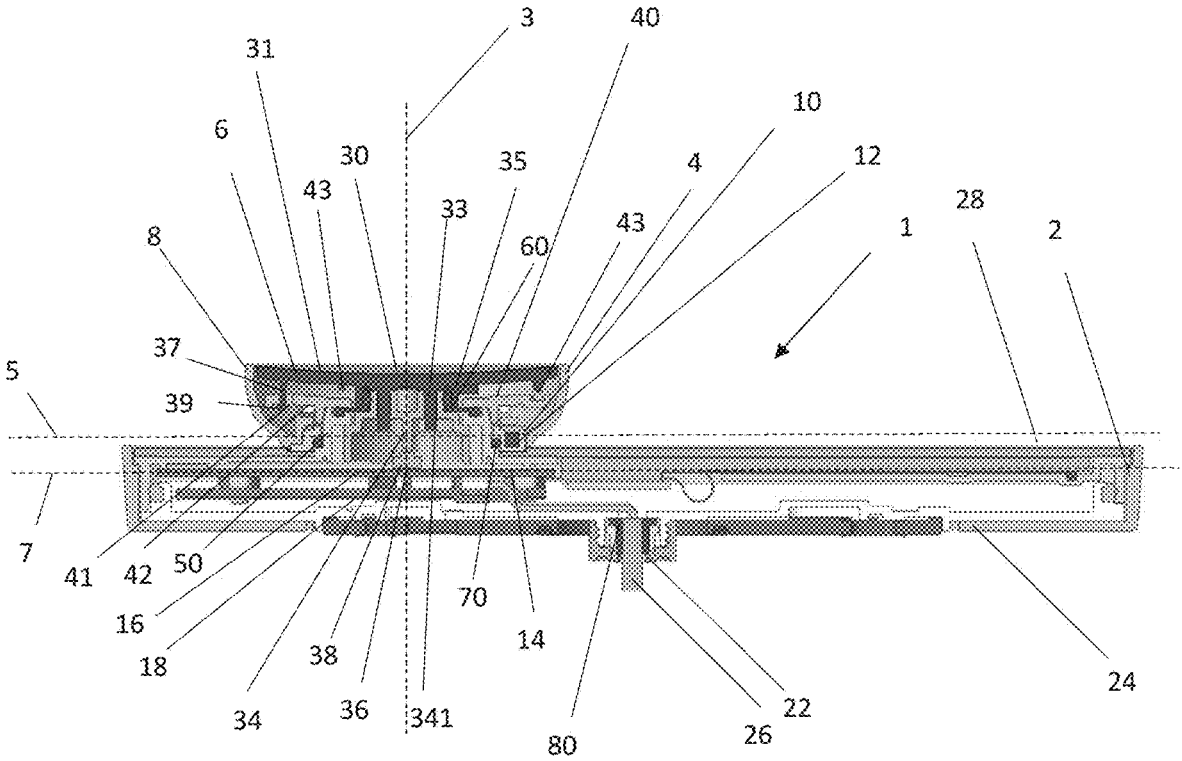
FIG. 1 is a cross-sectional view of a controller, according to an exemplary embodiment.

Controllers for use in ablutionary settings include, for example, digital shower controllers. A digital shower controller typically includes a manually operated mechanical input portion and electronic components configured to output a control signal in dependence on movement or the position of the mechanical input portion. The electronic components may be located within a sealed environment so as to protect the components from water in use. In use, the controller may be used to control one or more characteristics of the water sprayed from the shower in dependence on the control signal. For instance, the controller may be used to control actuation of an electronic valve (e.g. a solenoid valve) in dependence on the control signal. The electronic valve in turn may control mixing of a hot water supply and a cold water supply to control the temperature of water delivered by a fluid delivery device, such as a showerhead.

Referring generally to the figures, a controller includes a manually operable input device coupled to a base housing and having a first manual input member and a second manual input member. The manually operable input device includes a sealed environment disposed at least partially within the base housing. The sealed environment includes one or more electronic components that control one or more functions of a fluid delivery device, such as an ablutionary fitting (e.g., shower head). The one or more electronic components are configured to be actuated responsive to a user-initiated movement of the first manual input member and a user-initiated movement of the second manual input member. The first manual input member and the second manual input member are disposed at least partially outside the sealed environment The second manual input member is movable (e.g. rotatable) relative to the first manual input member. The first manual input member may not move (e.g. rotate) when the second manual input member is moved (e.g. rotated) relative to the first manual input member. The manually operable input device may comprise one or more further manual input members. For instance, the manually operable input device may comprise a third manual input member and, optionally, a fourth manual input member and, further optionally, a fifth manual input member and, further optionally, a sixth manual input member, etc.

One or more of the manual input members may be movable in an arc about an axis. The arc may be bounded. Alternatively, the arc may be continuous (i.e. the manual input member may be rotatable about the axis without any limits). The one or more manual input members movable in an arc about an axis may comprise a rotary dial, a bezel, a lever or a handle.

One or more of the manual input members may be slidable (e.g. within a slot or groove). The slidable manual input member(s) may comprise a lever or a handle. One or more of the manual input members may comprise a touchscreen or a keypad. The touchscreen or keypad may be configured such that it does not rotate. One or more of the manual input members may comprise a push-button. The push-button may comprise an input portion. The input portion may comprise a linear button or a rocker.

In an example implementation: the first manual input member may comprise a push-button comprising an input portion; the second manual input member may comprise a rotary dial or bezel which is rotatable around the circumference of the input portion. In use, the input portion of the push-button may not rotate and the rotary dial or bezel may be rotatable relative to the input portion of the push-button. The rotary dial or bezel may be located outside the sealed environment. The input portion of the push-button may be located at least partially outside the sealed environment. The one or more seals may comprise a diaphragm seal arranged to be compressed through actuation of the input portion of the push-button.

The push-button may comprise an actuation portion which extends from the input portion into the sealed environment, and the one or more electronic components may comprise a contact portion arranged to be actuated by the actuation portion. Movement of the actuation portion may be sensed by a non-contact sensor arranged to detect movement of the actuation portion and output a signal to the one or more electronic components.

In embodiments comprising a push-button, the input portion may be resiliently biased. The input portion may be resiliently biased away from the one or more seals. The input portion may be resiliently biased by one or more resilient biasing elements. The one or more resilient biasing elements may comprise, for example, one or more springs, although any suitable resilient biasing element(s) may be employed.

The one or more seals may comprise any suitable sealing means (e.g. a diaphragm seal and/or an o-ring seal). The one or more seals may be made from any suitable material.

In embodiments comprising a push-button, a diaphragm seal may be arranged to be compressed through actuation of the input portion.

In an example embodiment, there may be no sealing between the input portion of the push-button and the rotary dial or bezel.

The rotary dial or bezel may be configured such that it is freely rotatable. The rotary dial or bezel may be configured to be rotatable between two pre-defined limits. The rotary dial or bezel may be configured to rotate incrementally. The rotary dial or bezel may be configured to rotate about a single axis of rotation, the axis of rotation passing through or near to a center point of the or a manual input member disposed within a circumference of the rotary dial or bezel. The manual input member disposed within the circumference of the rotary dial or bezel may comprise a push-button, a touch screen and/or a keypad.

The controller may comprise a non-contact location sensing system comprising a first part disposed on or in one or more of the manual input members and a second part disposed within the sealed environment, wherein user-initiated movement of the manual input member causes movement of the first part relative to the second part. The first part or the second part may be configured to detect movement of the other of the first part and the second part and to output a signal in dependence on the user-initiated movement of the first part relative to the second part. The non-contact location sensing system may be configured such that, in use, the first part and the second part never lie in a common plane and are never radially offset from one another relative to an axis extending perpendicularly from the base housing and passing through the manually operable input device.

An example of a suitable non-contact location sensing system may include a magnetic sensing system or an optical sensing system. In an example implementation, the first part may comprise one or more magnets and the second part may comprise one or more sensors arranged to detect movement of the magnet(s). The sensor(s) may comprise, for example, one or more Hall effect sensors and/or one or more reed switches.

The controller may comprise a magnetic sensing system. The magnetic sensing system may comprise one or more magnets and one or more sensors. The one or more sensors may be located within the sealed environment and the one or more magnets may be arranged external to the sealed environment. Alternatively, the one or more magnets and the one or more sensors may be located within the sealed environment. Alternatively, the one or more sensors may be located within the sealed environment and the one or more magnets may be located within a further, separate, sealed environment. Alternatively, at least one magnet may be located external to the sealed environment and at least one magnet may be located within the sealed environment. Alternatively, no magnets may be located within the sealed environment. Alternatively, all the magnets may be located within the sealed environment.

The magnetic sensing system may comprise a plurality of magnets and a plurality of sensors. The magnetic sensing system may comprise more sensors than magnets. The magnetic sensing system may comprise a plurality of magnets. The magnetic sensing system may comprise up to five magnets or up to four magnets. The magnetic sensing system may comprise four or more sensors, five or more sensors, six or more sensors, seven or more sensors or eight or more sensors. In an example implementation, the magnetic sensing system may comprise three magnets and eight sensors.

The magnet(s) may be disposed within the or a rotary dial or bezel such that they rotate with the rotary dial or bezel. The one or more magnets may be disposed within or upon a magnet holder. The magnet holder may comprise a waterproof seal arranged to extend at least partially around the one or more magnets. The magnet holder and waterproof seal may create a second sealed environment around the one or more magnets. The magnet holder may be affixed to the rotary dial and/or bezel such that the magnet holder is arranged to rotate with the rotary dial. The magnet holder may be detachably connected to the rotary dial.

The magnet holder may be pivotable, slidable, or rotatable relative to the push-button. The magnet holder may be continuously rotatable relative to the push-button. The magnet holder may be rotatable relative to the push-button within a fixed angular range.

In order to be suitable for use in a wet environment, magnets typically need to be protected, in order to inhibit corrosion. For example, magnets may be protected with means such as a polymer (e.g. resin, coating, etc.) or a metal (e.g. nickel, plating, etc.). The need for such treatments may make magnets relatively more expensive than sensors. In some example implementations, the controller may comprise a magnetic sensing system comprising fewer magnets than sensors. Consequently, manufacturing costs of the controller may be relatively reduced. Another benefit may be that relatively less magnetic material may be required, which may help to limit manufacturing costs and/or may minimize possible supply problems.

The optical sensing system may comprise one or more light sources and one or more optical sensors. The one or more light sources or the one or more optical sensors may located within the sealed environment, and the other of the one or more light sources and one or more optical sensors may be arranged disposed in or on one or more of the manual input members.

The one or more magnets may comprise at least a first magnet and a second magnet. A distance between a center of the first magnet and a center of the second magnet may be less than one quarter of a perimeter of the magnet holder and/or bezel. A distance between a center of the first magnet and a center of the second magnet may be greater than one quarter of a perimeter of the magnet holder and/or bezel. The first magnet and the second magnet may be arranged on a circumference of a nominal circle. A distance between a center of the first magnet and a center of the second magnet may be less than 180 degrees of the nominal circle. A distance between a center of the first magnet and a center of the second magnet may be less than 160 degrees or less than 140 degrees. A distance between a center of the first magnet and a center of the second magnet may be within the range of 115 degrees to 125 degrees. A distance between a center of the first magnet and a center of the second magnet may be 120 degrees. The one or more magnets may be arranged on a circumference of a first nominal circle.

The plurality of sensors may be spaced equidistantly from one another. The plurality of sensors may comprise four or more sensors. The plurality of sensors may comprise eight or more sensors. The plurality of sensors may comprise sixteen sensors. Any suitable number of sensors may be provided wherein the number of sensors is greater than the number of magnets. The plurality of sensors may be arranged on a circumference of a second nominal circle.

The first nominal circle may lie in a first plane and the second nominal circle may lie in a second plane, the second plane being parallel to the first plane. The first nominal circle may be aligned with the second nominal circle.

The plurality of sensors may be spaced apart from the plurality of magnets in an axial direction, where the axis may be an axis of rotation of the bezel and/or rotary dial. The nominal circle the circumference of which the plurality of magnets may be arranged may comprise a substantially similar diameter to the nominal circle the circumference of which the plurality of sensors may be arranged. The plurality of sensors may be disposed closer to the electronic components than the plurality of magnets.

In some embodiments, the controller may comprise a processor configured to receive a signal from each of the sensors, and distinguish between a signal output from each of the sensors. In some embodiments, the controller may form part of a wider control system, the control system comprising a processor configured to receive a signal from each of the sensors, and distinguish between a signal output from each of the sensors.

The processor may be configured to output a control signal in dependence on the signal(s) received from the sensors. The processor may be configured to output a control signal in dependence on the order and/or number of signals received from the sensors. For example, the processor may be configured to determine the direction and/or amount of rotation of the magnets and/or magnet holder in dependence on the order and number of signals received from the sensors. For example, the processor may be configured to output a control signal in dependence on the direction and/or amount of rotation of the magnets and or magnet/magnet holder. For example, where the controller forms part of a fluid delivery system in use, the controller may be operable to increase or decrease the temperature of water delivered by a fluid delivery device of the fluid delivery system by a given amount in dependence on the direction and/or amount of rotation of the magnets and/or magnet holder.

In some embodiments, the magnets and/or magnet holder may be rotatable relative to the housing within a fixed angular range. In such embodiments, the sensors may be arranged along an arc of the nominal circle. The sensors may be spaced equidistantly from one another along the arc of the nominal circle. The central angle of the arc may be substantially equal to the fixed angular range of rotation of the magnet holder.

Any suitable type of sensor or magnet may be used. At least one of the sensors may comprise a Hall effect sensor. At least one of the sensors may comprise a sensor other than a Hall effect sensor (e.g. a reed switch). At least one of the magnets may comprise a rare earth magnet.

The base housing may comprise a rear surface. The rear surface may be adapted to be fixed, in use, to a mounting surface such as a wall. In some embodiments, the rear surface may comprise one or more apertures suitable for one or more electrical cables or wires to extend therethrough. One or more seals may be arranged to provide a substantially watertight seal around the electrical cables or wires passing through the apertures in the rear surface of the base housing.

The manually operable input device may extend from a front face of the base housing. The controller may comprise a digital shower controller for a bathroom, for example. The wet environment may comprise an ablutionary setting.

The electronic components may be operable to control at least one function of an ablutionary fitting, for example, in response to user-initiated movement of one or more of the manual input members. The ablutionary fitting may comprise a shower or a faucet, for example.

Figure 2:
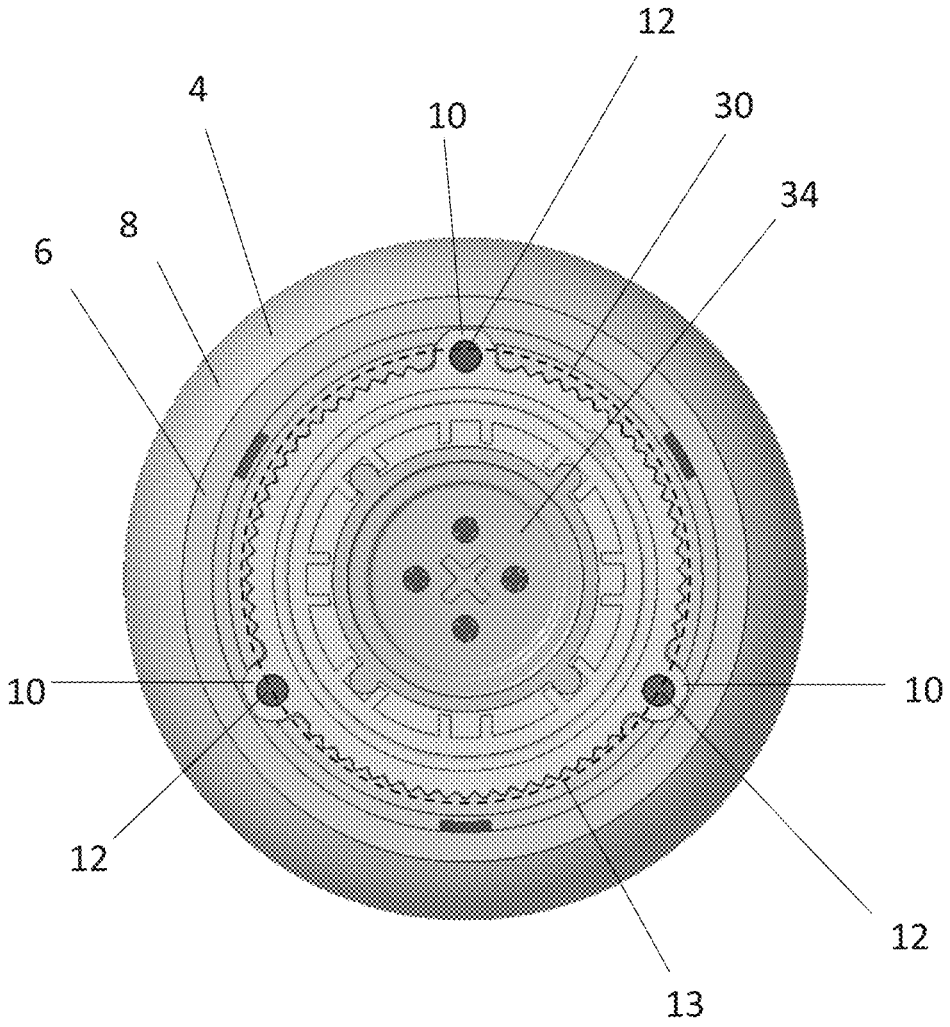
FIG. 2 is a sectional rear view of a rotary dial and a push-button of the controller of FIG. 1, according to an exemplary embodiment.

Referring to FIGS. 1 and 2, a controller 1 is shown. The controller 1 comprises a base housing 2. The base housing 2 generally has the form of a panel with an internal volume. The base housing 2 has a front face 28 and a rear face 24. The rear face 24 is adapted to facilitate fixing of the base housing 2 to a mounting surface (not shown) such as a wall, in use.

A manually operable input device 8 protrudes from the front face 28 of the base housing 2. The manually operable input device 8 comprises a push-button 6 (e.g., a first manual input member) and a bezel 4 (e.g., a second manual input member). The bezel 4 is rotatable around an axis 3, which is perpendicular to the front face 28 of the base housing 2. The push-button 6 is disposed within the bezel 4 and is movable linearly in a direction along the axis 3. The axis 3 passes through the center of the push-button 6. The bezel 4 is movable (e.g. rotatable) relative to the push-button 6. The push-button 6 may not move (e.g. rotate) when the bezel 4 is moved (e.g. rotated) relative to the push-button 6. The manually operable input device 8 may comprise one or more further manual input members. For instance, the manually operable input device may comprise a third manual input member and, optionally, a fourth manual input member and, further optionally, a fifth manual input member and, further optionally, a sixth manual input member etc.

The push-button 6 comprises an input portion 30 having a circular external surface 31 intended to be pressed by a user. A first annular wall 33 and a second annular wall 35 extend in a direction away from the external surface 31. The first annular wall 33 extends a bigger distance in the direction away from the external surface 31 than the second annular wall 35. The first annular wall 33 and the second annular wall 35 are arranged concentrically about the axis 3. The second annular wall 35 is radially outside the first annular wall 33.

At a position radially outside the second annular wall 35 an element 37 with a hook 39 at its distal end extends in a direction away from the external surface 31. The element 37 extends through an aperture 41 in a stationary element 40 such that the hook 39 catches on an underside 42 of the stationary element 40.

The input portion 30 is resiliently biased towards a first position by three equally circumferentially-spaced springs 43, which extend between an underside of the input portion 30 and the stationary element 40. The hook 39 catching on the underside 42 of the stationary element 40 counteracts the force of the springs 43 after a user stops pressing the push-button 6, thereby holding the input portion 30 in the first position ready for the user to press the push-button 6 again later.

The push-button 6 further comprises an actuation portion 34, which is connected to the input portion 30. The first annular wall 33 is received in an annular aperture 341 in a first end of the actuation portion 34. The stationary element 40 extends around the second annular wall 35. The stationary element 40 is disposed radially outside the second annular wall 35. The second annular wall 35 is disposed radially outside the actuation portion 34. The stationary element 40 sits on top of and is connected to a collar 50 which extends out from within the base housing 2.

A first sealing element 60 is configured to provide a water-tight seal between the second annular wall 35 and the actuation portion 34 and between the stationary element 40 and the collar 50.

Adjacent the front face 28 of the base housing 2, the bezel 4 comprises three magnet holders 10, each magnet holder 10 containing a magnet 12. Each magnet 12 may be held and sealed within a magnet holder 10 by any suitable means. The magnets 12 are disposed at regular intervals around a first nominal circle 13 (FIG. 2) located in a first plane indicated by a first dashed line 5 in FIG. 1.

A second sealing element 70 is configured to provide a water-tight seal between the bezel 4 and the collar 50. The combination of the first sealing element 60 and the second sealing element 70 means that water cannot pass through the manually operable input device 8 into the base housing 2.

A printed circuit board ("PCB") 16 is disposed within the base housing 2 and extends laterally beneath the manually operable input device 8. The PCB 16 lies in a second plane indicated in FIG. 1 by dashed line 7. The second plane is parallel to the first plane. The PCB 16 includes a contact point 36 located in line with the actuation portion 34. One or more Hall effect sensors 14 are arranged on the PCB 16. For example, eight Hall effect sensors 14 are arranged on the PCB 16. The Hall effect sensors 14 are located at regular intervals around a second nominal circle (not shown) located in the second plane. The second nominal circle is aligned with the first nominal circle 13.

The PCB 16 is disposed on a support frame 18. A cable 26 extends through an aperture 22 in the rear face 24 of the base housing 2. A third sealing element 80 is configured to provide a water-tight seal around the cable 26 as it passes through the aperture 22. The cable 26 provides an electrical connection for supplying power to the controller 1 and a data connection for transmitting information to and from other devices that may be operably connected to the controller 1. Such other devices may include, for example, one or more valves operable to control water flow to a fluid delivery device.

It will be appreciated that the printed circuit board 16 is within a sealed environment. The bezel 4 is outside the sealed environment. Most of the input portion 30 of the push-button 6 is located outside the sealed environment. For example, according to one embodiment, the only part of the input portion 30 that extends into the sealed environment is the first annular wall 33. The first manual input member and/or the second manual input member may be disposed substantially entirely outside the sealed environment.

Operation of the controller 1 will now be described. The controller 1 comprises a manually operable input device 8 comprising two input members, i.e. the push-button 6 and the bezel 4. A user can operate the controller 1 by pushing the push-button 6 and/or turning the bezel 4. In one example implementation, pushing the push-button 6 may act to turn an associated fluid delivery device on and off, while turning the bezel 4 may act to control water temperature and/or flow rate.

To operate the push-button 6, the user pushes the input portion 30 to urge a second end 38 of the actuation portion 34 into contact with the contact point 36 on the PCB 16. When the user stops pushing the input portion 30, the springs 43 act to cause the push-button 6 to return to the first position ready for the user to push the input portion 30 again.

When the user rotates the bezel 4, the magnets 12 move relative to the Hall effect sensors 14. Each Hall effect sensor 14 is configured to output a signal in dependence on the position of the magnets 12 relative to the sensors 14.

Figure 3:
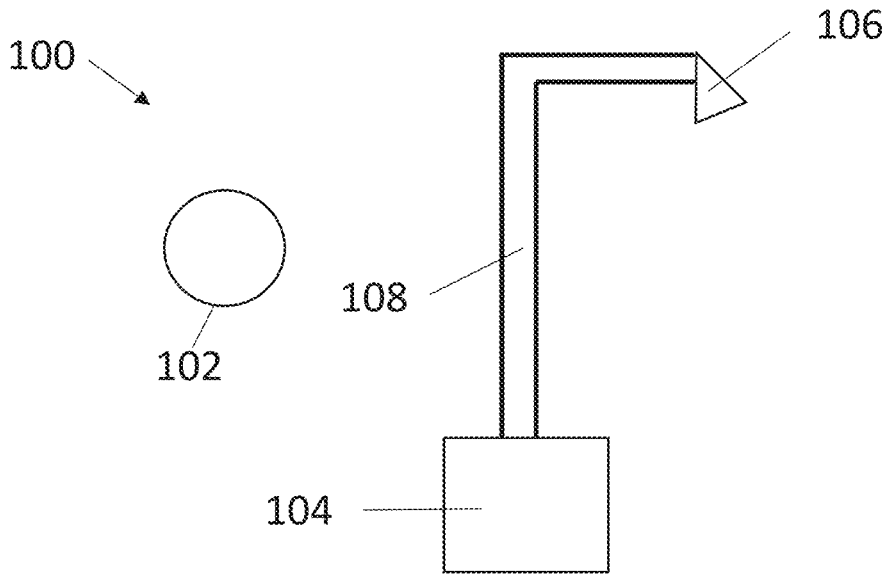
FIG. 3 is a schematic of a fluid delivery system, according to an exemplary embodiment.

FIG. 3 illustrates schematically an ablutionary system 100. The ablutionary system 100 comprises a controller 102, a fluid delivery device 106 and a valve 104. The controller 102 is a controller according to the present disclosure (e.g. the controller 1), and is operable to control one or more characteristics of the fluid delivered, in use, by the fluid delivery device 106. A pipe 108 provides a means for conveying a flow of fluid from the valve 104 to the fluid delivery device 106. The controller may be operably connected to one or more valves upstream of the fluid delivery device. For example, the controller 102 is operably connected to the valve 104, to enable user control of one or more characteristics of the fluid delivered, in use, by the fluid delivery device 106. The controller may be operably connected to a mixer valve (e.g. a thermostatic mixer valve). The fluid delivery system may comprise a flow valve operable to control flow of fluid to the fluid delivery device. The controller may be operable to control the flow valve. The fluid delivery system may comprise a temperature valve operable to control temperature of fluid to the fluid delivery device. The controller may be operable to control the temperature valve.

Consequently, at least one function of the ablutionary system 100 is controlled by the controller 102. Typically, the valve 104 may comprise a mixer valve (e.g. a thermostatic mixer valve). The controller 102 may be configured to provide user control of fluid temperature and/or flow rate.

The system 100 may comprise more than one fluid delivery devices. In such an example implementation, the controller 102 may be configured to enable user selection of one or more of the fluid delivery devices at any given time.

The fluid delivery system may comprise a plurality of fluid delivery devices. The controller may be operable to control one or more characteristics of the fluid delivered, in use, by each one of the plurality of fluid delivery device. The fluid delivery device(s) may each comprise a sprayer, a showerhead or a faucet, for example. The fluid delivery system may be coupled to a fluid supply (e.g. a plumbing system providing cold and/or hot water).

Various modifications can be made to the example embodiments described herein without departing from the scope of the present disclosure.

While the example embodiments have been described as being suitable for use in an ablutionary setting, it should be understood that they may be suitable for use in wet environments other than an ablutionary setting.

Except where mutually exclusive, any of the features may be employed separately or in combination with any other features and the disclosure extends to all combinations and sub-combinations of one or more features disclosed herein.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the present disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the controller as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present disclosure. For example, any element disclosed in one embodiment may be incorporated or utilized with any other embodiment disclosed herein.

What is claimed is:

1. A controller for use in a wet environment, comprising:

a manually operable input device coupled to a base housing, the manually operable input device including:

a first manual input member for activating one of an "on" or "off" function of a fluid delivery device;

a second manual input member for adjusting at least one of a temperature and a flow rate of a fluid provided by the fluid delivery device, the second manual input member movable relative to the first manual input member; and a sealed environment disposed at least partially within the base housing, wherein the sealed environment includes one or more electronic components;

wherein the one or more electronic components are configured to control at least one function of the fluid delivery device;

wherein the one or more electronic components are configured to be actuated responsive to a user-initiated movement of the first manual input member and a user-initiated movement of the second manual input member;

wherein the first manual input member and the second manual input member are disposed at least partially outside the sealed environment;

wherein a portion of the first manual input member is disposed within a portion of the second manual input member; and wherein one of the first and second manual input members includes an input portion including a first annular wall received in a first end of the actuation portion for actuating the one or more electronic components and an actuation portion extending from the input portion into the sealed environment, the input portion further including a second annular wall disposed radially outward of the actuation portion and the first annular wall, the second annular wall forming a portion of the sealed environment such that the first annular wall is the only portion of the input portion extending into the sealed environment.

2. The controller according to claim 1, wherein the first manual input member does not move when the second manual input member is moved.

3. The controller according to claim 1, wherein the manually operable input device further comprises a third manual input member.

4. The controller according to claim 1, wherein at least one of the first manual input member and the second manual input member is movable in an arc about an axis.

5. The controller according to claim 1, wherein at least one of the first manual input member and the second manual input member is at least one of a rotary dial, a bezel, a lever, and a handle.

6. A controller according to claim 1, wherein at least one of the first manual input member and the second manual input member is slidable.

7. The controller according to claim 1, wherein at least one of the first manual input member and the second manual input member includes at least one of a touchscreen and a keypad.

8. The controller according to claim 1, wherein at least one of the first manual input member and the second manual input member includes a push-button.

9. The controller according to claim 8, wherein the push-button includes an input portion.

10. The controller according to claim 9, wherein the input portion includes at least one of a linear button and a rocker.

11. The controller according to claim 1, wherein:

the first manual input member includes a push-button having an input portion; and the second manual input member includes at least one of a rotary dial and a bezel that is rotatable around a circumference of the input portion.

12. The controller according to claim 11, wherein:

the push-button includes an actuation portion that extends from the input portion into the sealed environment; and the one or more electronic components include a contact portion configured to be actuated by the actuation portion.

* * * * *